US009061346B2

(12) United States Patent
Hebert et al.

(10) Patent No.: US 9,061,346 B2
(45) Date of Patent: Jun. 23, 2015

(54) DIE LOCKING SYSTEM AND METHOD

(75) Inventors: David Hebert, Shrewsbury, MA (US); Matthew John Villani, Savannah, GA (US); David Livingston, The Woodlands, TX (US)

(73) Assignee: FIRTH RIXSON LIMITED, East Hartford, CT (US)

( * ) Notice: Subject to any disclaimer, the term of this patent is extended or adjusted under 35 U.S.C. 154(b) by 599 days.

(21) Appl. No.: 13/451,101

(22) Filed: Apr. 19, 2012

(65) Prior Publication Data

US 2013/0276506 A1 Oct. 24, 2013

(51) Int. Cl.

| | |
|---|---|
| ***B21D 37/14*** | (2006.01) |
| ***B21D 37/02*** | (2006.01) |
| ***B21J 13/03*** | (2006.01) |
| *B21J 5/00* | (2006.01) |

(52) U.S. Cl.

CPC ..... *B21J 13/03* (2013.01); *B21D 37/14* (2013.01); *B21D 37/02* (2013.01); *B21J 5/00* (2013.01)

(58) Field of Classification Search

CPC ..... B21D 37/02; B21D 37/04; B21D 37/06; B21D 37/14; B21J 13/03; B21J 13/085

See application file for complete search history.

(56) References Cited

U.S. PATENT DOCUMENTS

| | | | |
|---|---|---|---|
| 2,984,176 | A | 5/1961 | Sommer et al. |
| 3,779,122 | A | 12/1973 | Sawvell |
| 4,413,499 | A | 11/1983 | Diemer et al. |
| 4,649,731 | A | 3/1987 | Eisenmann |
| 6,457,341 | B1 | 10/2002 | Wirgarth |
| 7,194,887 | B2 | 3/2007 | Aubry et al. |
| 2009/0031780 | A1 * | 2/2009 | Bandou et al. ..... 72/481.2 |
| 2010/0307216 | A1 | 12/2010 | De Souza et al. |

FOREIGN PATENT DOCUMENTS

| | | | |
|---|---|---|---|
| DE | 1194227 | B2 | 6/1965 |
| JP | 20100137284 | B2 | 6/2010 |

OTHER PUBLICATIONS

Interntational Search Report issued in International Application No. PCT/US2013/033794 dated Jul. 2, 2013; 5 pages.

Written Opinion of the International Searching Authority issued in International Application No. PCT/US2013/033794 dated Jul. 2, 2013; 5 pages.

Notification Concerning Transmittal of International Preliminary Report on Patentability (Chapter I of the Patent Cooperation Treaty), issued in Interntional Application No. PCT/US2013/033794, dated Oct. 30, 2014; 7 pages.

* cited by examiner

*Primary Examiner* — Debra Sullivan

(74) *Attorney, Agent, or Firm* — Cantor Colburn LLP

(57) ABSTRACT

A die locking device including a press having a top end, a bottom end and a plurality of channels disposed around a perimeter of the press. The device also includes a plurality of actuators, each of the plurality of actuators affixed to a first end of one of a plurality of locking arms that are each at least partially disposed in one of the plurality of channels. The device also includes a plurality of locking clips, each affixed to a second end of each of the plurality of locking arms and each affixed to one of a plurality of hinges. The plurality of hinges is configured to receive and secure a die stack to the top end of the press.

10 Claims, 5 Drawing Sheets

DIE LOCKING SYSTEM AND METHOD

BACKGROUND

The present disclosure generally relates to systems and methods for locking dies. More particularly, the present disclosure relates to systems and methods for locking dies used in isothermal forging applications.

Many metallic materials having great high-temperature strength such as titanium and nickel-based alloys are characteristically difficult to process. One effective way of processing such materials is by isothermal forging, in which the forging die is heated to the forging temperature of the metal concerned.

Most isothermal dies are disk-shaped and are generally constituted of two disk-shaped die halves whose mating surfaces have been formed with die cavities. At the time of isothermal forging, the two die halves are mated with the work-piece to be forged disposed between them and the result, referred to as a die stack, is loaded into a forging press and heated. Typically, the die stack is secured in the forging press by a series of bolts that are manually tightened prior to heating the die stack. As die stack is heated the die stack experiences thermal expansion. Depending on the amount of thermal expansion and how tight the bolts securing the die stack are, the thermal expansion may cause the dies and/or connecting bolts to break. Alternatively, if the bolts are insufficiently tightened in an attempt to prevent the disk from breaking, the dies may be able to move relative to each other during the forging process.

Accordingly, what is needed is a method and system for locking dies in an isothermal forging process that prevents the dies from breaking due to thermal expansion while preventing the dies from moving.

BRIEF SUMMARY

Disclosed herein are systems and methods for locking dies that can be used in an isothermal forging application.

In accordance with one embodiment of the disclosure, a die locking device including a press having a top end, a bottom end and a plurality of channels disposed around a perimeter of the press. The device also includes a plurality of actuators, each of the plurality of actuators affixed to a first end of one of a plurality of locking arms that are each at least partially disposed in one of the plurality of channels. The device also includes a plurality of locking clips, each affixed to a second end of each of the plurality of locking arms and each affixed to one of a plurality of hinges. The plurality of hinges are configured to receive and secure a die stack to the top end of the press.

In accordance with another embodiment of the disclosure, a method for die locking includes placing a die stack in a die locking device, wherein the die locking device includes a press having a top end, a bottom end and a plurality of channels disposed around a perimeter of the press. The device also includes a plurality of actuators, each of the plurality of actuators affixed to a first end of one of a plurality of locking arms that are each at least partially disposed in one of the plurality of channels. The device also includes a plurality of locking clips, each affixed to a second end of each of the plurality of locking arms and each affixed to one of a plurality of hinges. The plurality of hinges are configured to receive and secure a die stack to the top end of the press. The method also includes monitoring a force exerted by the hinges on the die stack and responsively adjusting the position of the plurality of actuators to maintain the force in a desired range.

In accordance with a further embodiment of the disclosure, a method of die locking during an isothermal forging application includes placing a die stack into a forging press. The method also includes securing the die stack to the forging press with one or more adjustable locking devices and heating the die stack and forging press. The method further includes monitoring a growth of the die stack and adjusting the one or more adjustable locking devices based on the growth of the die stack.

The disclosure may be understood more readily by reference to the following detailed description of the various features of the disclosure and the examples included therein.

BRIEF DESCRIPTION OF THE DRAWINGS

Referring now to the figures wherein the like elements are numbered alike.

DETAILED DESCRIPTION

Disclosed herein are methods and systems for die locking which may be used during an isothermal forging application. Generally, during isothermal forging applications a die stack including two detail dies and a work-piece are secured to a forging press with one or more adjustable locking devices. The adjustable locking devices are configured such that during the use of the press the force exerted on the die stack can be controlled. By controlling the force exerted on the die stack during the forging process the adjustable locking devices can prevent the movement and breakage of the detail dies.

FIGS. 1-4 illustrate a die locking system in accordance with an exemplary embodiment of the present disclosure. It will be appreciated by those of ordinary skill in the art that the configuration of the die locking system may be modified or changed in various aspects without departing from the invention of the present disclosure.

Figure 1:
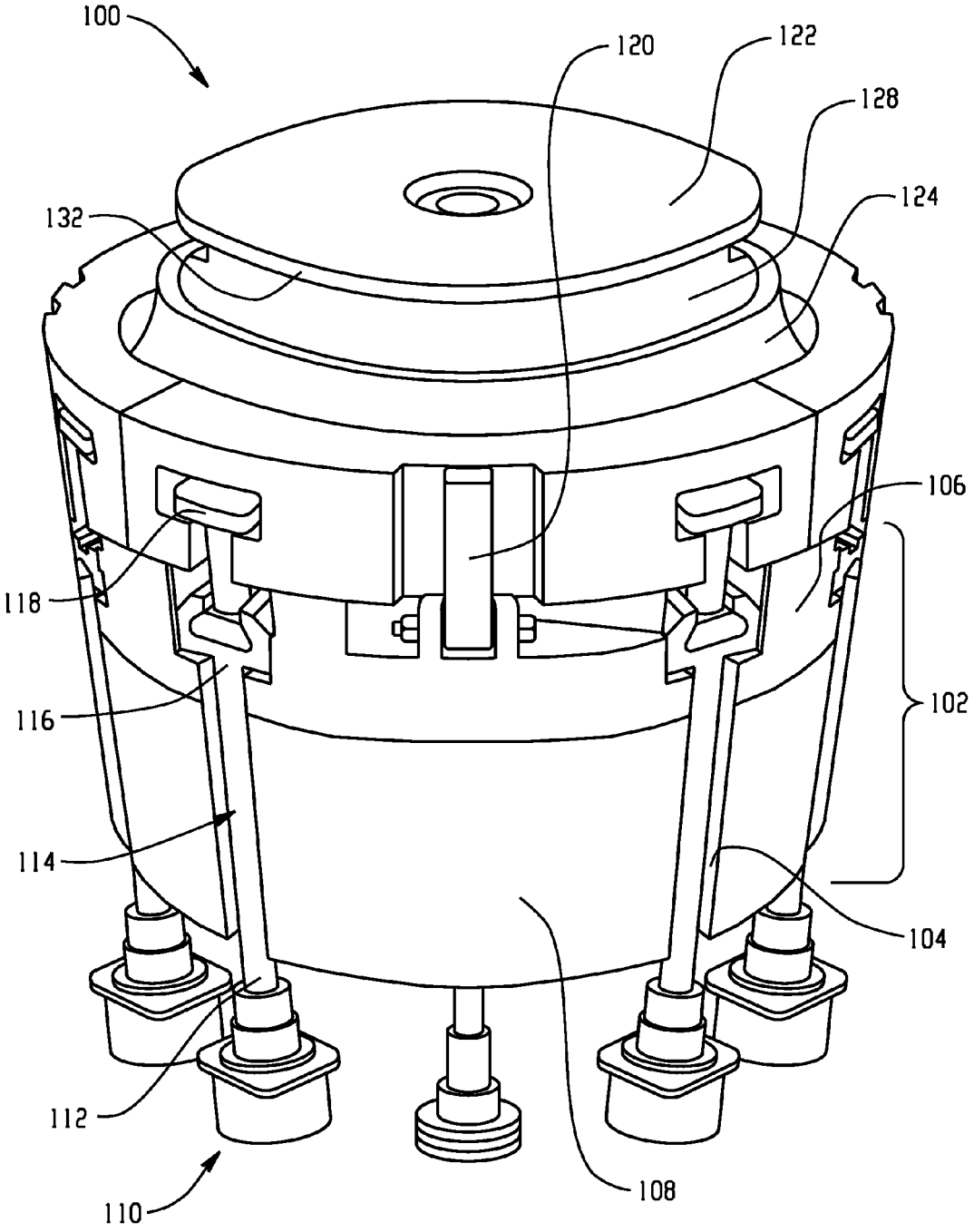
FIG. 1 is a perspective view of a die locking device in a locked state in accordance with an embodiment of the present disclosure.

Referring to FIG. 1, a die locking device 100 in a locked state in accordance with an embodiment of the present disclosure is shown. The die locking device 100 includes a press 102 having a plurality of channels 104 disposed around the perimeter of the press 102. In exemplary embodiments, the press is generally cylindrical in shape and has a top end 106 and a bottom end 108. The die locking device 100 also includes a plurality of actuators 110 that are each affixed to a first end 112 of a locking arm 114. In exemplary embodiments, the actuators 110 are also affixed to the bottom end 108 of the press 102 and are configured to move the locking arm 114 within the channels 104. A second end 116 of the locking arms 114 is configured to receive a locking clip 118. The locking clip 118 is also configured to engage a hinge 120. In exemplary embodiments, the hinge 120 may be designed to engage with one or more locking clips 118. The hinges 120 are configured to receive a die stack 122 and to secure the die stack 122 to the press 102. In exemplary embodiments, a locking ring 124 can be disposed between the hinges 120 and the die stack 120. In other exemplary embodiments, the hinges 120 may directly contact the die stack 120.

During operation of the die locking device 100, as the actuators 110 move the locking arms 114 toward the top end 106 of the press 102, the force exerted on the die stack 122 by the hinges 120 decreases. Likewise, as the actuators 110 move the locking arms 114 toward the bottom end 108 of the press, the force exerted on the die stack 122 by the hinges increases. In exemplary embodiments, by controlling the operation of the actuators 110 of the die locking device 100, the force exerted by the hinges 120 on the die stack 122, either directly or through the locking ring 124, can be controlled to allow the thermal expansion of the die stack 122 while maintaining sufficient force on the die stack 122 to prevent the dies from moving. During operation, the growth, or thermal expansion, of the die stack 122 can be monitored and the actuators 110 can be responsively adjusted to preclude damaging the die stack 122 from clamp pressure. In exemplary embodiments, the actuators 110 may be hydraulic actuators, mechanical actuators, pneumatic actuators, or the like.

Figure 2:
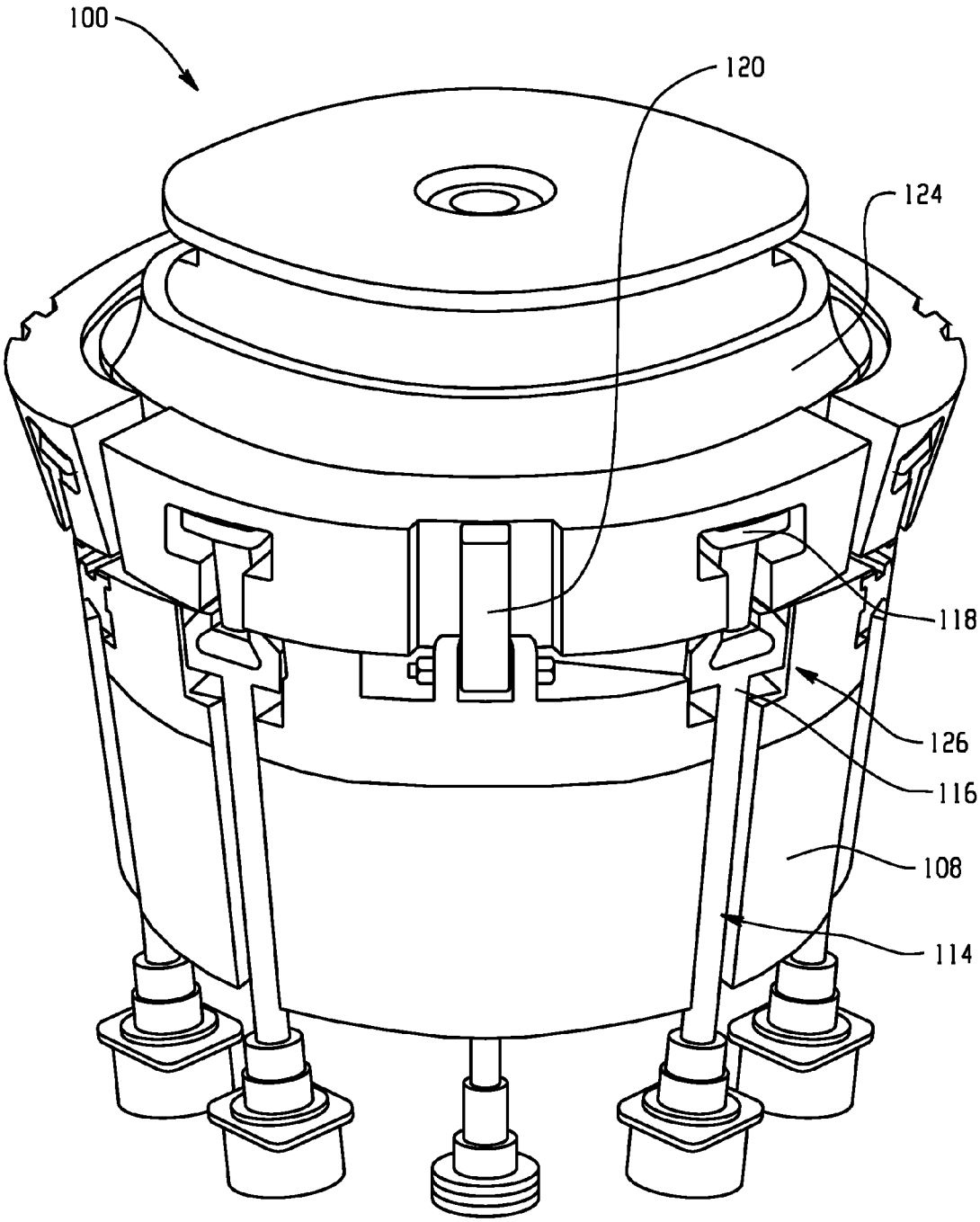
FIG. 2 is a perspective view of the die locking device of FIG. 1 in an unlocked state accordance with an embodiment of the present disclosure.

Continuing now with reference to FIG. 2, the die locking device 100 is shown in an unlocked state. In exemplary embodiments, the die locking device 100 includes an automatic unlocking capability using a hinge mechanism 126 in conjunction with the stroke of the actuator 110. As the locking arms 114 move in the direction of the top end 106 of the press 102, the hinges 120 are configured to radially pivot away from the press 102. In exemplary embodiments, the hinges 120 are pivotally affixed to the top end 106 of the press 102 by the hinge mechanism 126, such as a pin or bolt. When the die locking device 100 is in an unlocked state, as shown, the die stack 122 can be removed. In exemplary embodiments, the top detail die 128 of the die stack 122 may include a lip 132 that is configured to facilitate removal of the dies stack from the die locking device 100. In one embodiment, the lip 132 is configured such that a forklift, or other suitable device, can be used to lift and remove the top detail die 128 from the die locking device.

In exemplary embodiments, the die locking device 100 allows the die stack 122 to be loaded and unloaded into the press 102 without requiring the user to manually adjust bolts securing the die stack 122. This reduces the direct interaction between the user and the hot dies allowing for more easily changed die stacks 122 without having to wait for the entire die stack 122 to cool, as performed in current forging operations. In some forging processes, the die stack operates at about 2000 degrees Fahrenheit (° F.). When the detail dies are to be removed from the system, it is desirable to only reduce the temperature of the entire die stack to about 600 to 800° F. such that the locks can be opened. In existing processes, the entire die stack must be permitted to cool to significantly reduced temperatures, so that it is safe for a worker to go in and manually remove the bolts from the die stack to release the detail dies. The die locking device 100 permits mechanically automated release of the detail dies and, therefore, substantially complete cooling of the die stack is not necessary. The vacuum can be released and the die(s) can be removed with a machine, such as with a fork truck or similar—manual removal by a laborer is not necessary. Significant time and energy is saved by not having to substantially completely cool and reheat the die stack whenever a die change is required.

Figure 3:
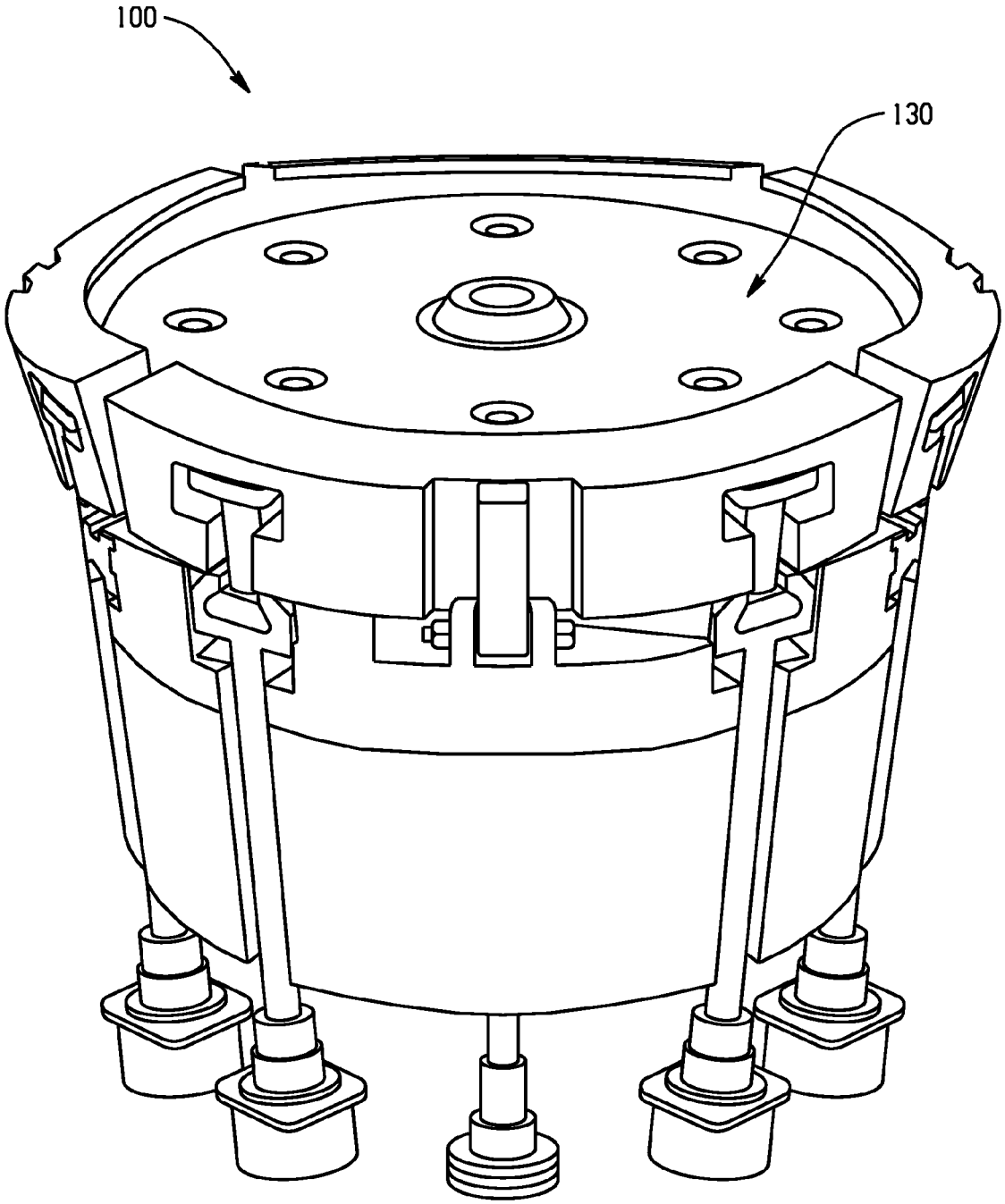
FIG. 3 is a perspective view of the die locking device of FIG. 1 in an unlocked state with the die stack removed in accordance with an embodiment of the present disclosure.

Referring now to FIG. 3, the die locking device of FIG. 1 is shown in an unlocked state with the top detail die 128 and locking ring 124 removed. As illustrated, the locking arms 114 are disposed in the channels 104 towards the top end 106 of the press 102. The channels 104 may be configured such that the second end 116 of the locking arm 114 is only permitted to slide up and down in the channel 104. As the locking arm 114 moves upward towards the top end 106 of the press 102, the second end 116 of the locking arm 114 pushes the locking clip 118 upward, which allows the hinges 124 to pivot away from the press 102.

Figure 4:
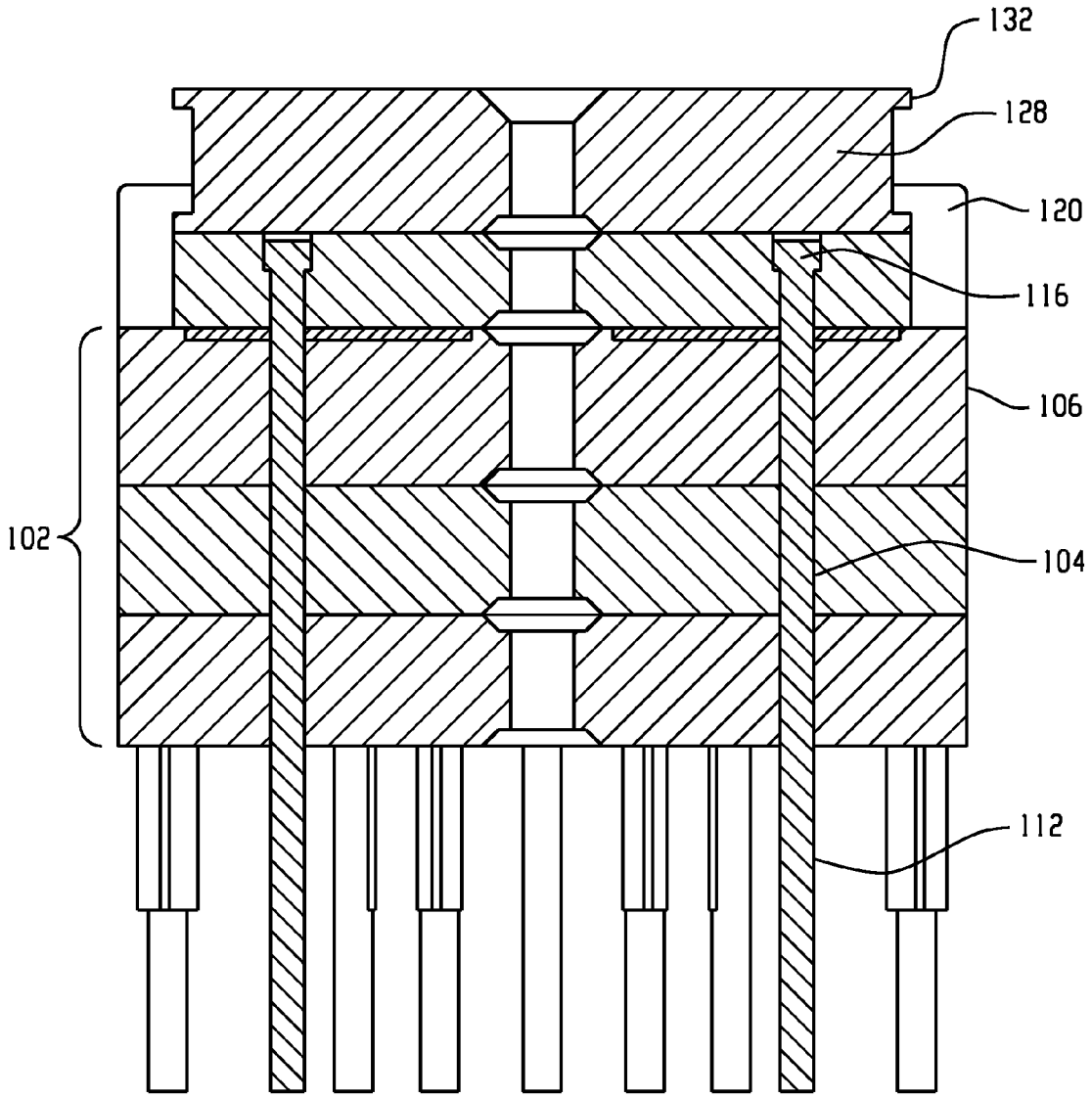
FIG. 4 is a cross-sectional view of the die locking device of FIG. 1 in a locked state in accordance with an embodiment of the present disclosure.

Referring now to FIG. 4, a cross section of the die locking device of FIG. 1 is shown. In exemplary embodiments, the die locking device 100 provides a more accurate and reliable method to apply force to die stack 122, which includes a top detail die 128 and bottom detail die 130, thereby increasing the life of the dies 128, 130 at the connection interface points. Additionally the die locking device 100 can be configured to use the same locking mechanism for die stacks 122 of varying sizes by incorporating different size locking rings 124 for different size die stacks 122.

In exemplary embodiments, the press 102 of the die locking device 100 may be made of one or more materials including but not limited to, Inconel 718, Inconel 100, or the like. In one embodiment, the top end 106 of the press 102 is made of Inconel 100 and the bottom end 108 of the press 102 is made of Inconel 718. In exemplary embodiments, the actuators may be made of a steel alloy such as tool steel 4140 or the like. In exemplary embodiments, the hinges 120 may be made of a molybdenum-based alloy. In exemplary embodiments, the top detail die 128 and the bottom detail die 130 may be made of an alloy, such as, for example, a molybdenum alloy, or the like. In exemplary embodiments, the locking arms 114 may be made of Inconel 718.

Figure 5:
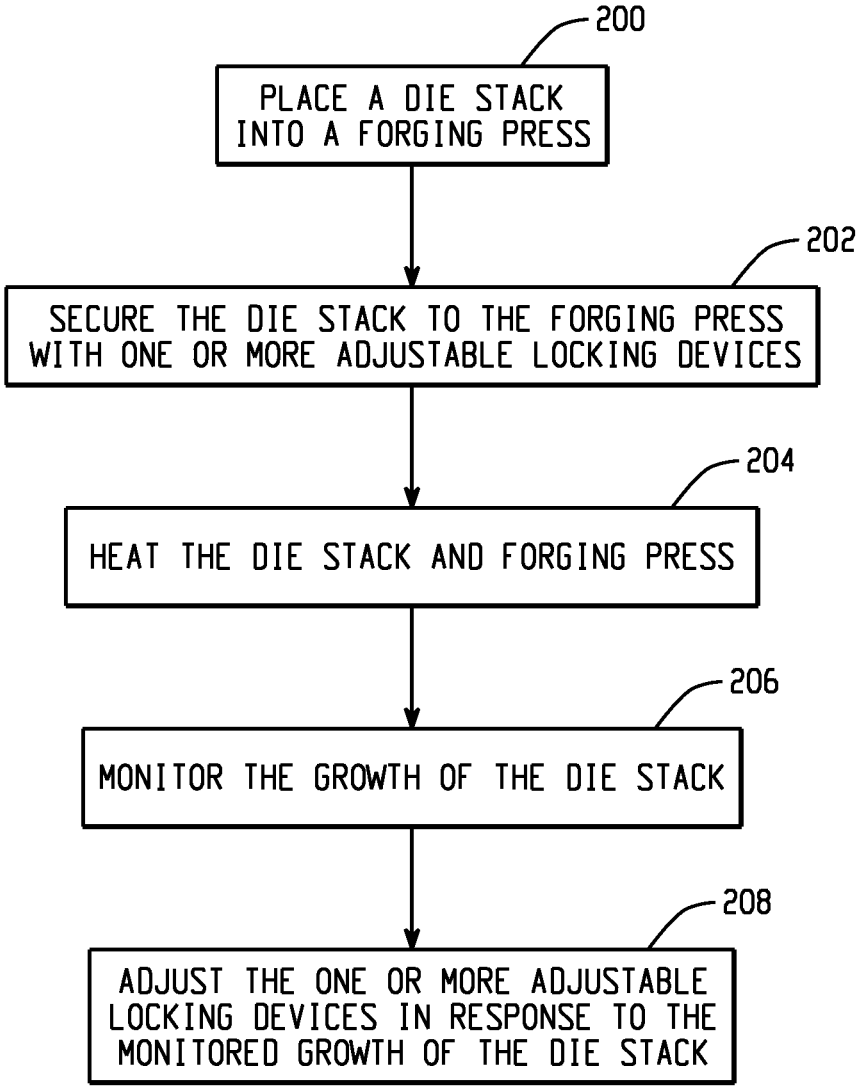
FIG. 5 is a flowchart illustrating a method for die locking in accordance with an embodiment of the present disclosure.

Referring now to FIG. 5, a flowchart illustrating a method for die locking in accordance with an exemplary embodiment is shown. The method may include placing a die stack into a forging press, as shown at block 200. Next, as shown at block 202, the method includes securing the die stack to the forging press with one or more adjustable locking devices. After the die stack has been secured, the die stack and forging press are heated, as shown at block 204. During heating, the growth of the die stack is monitored, as shown at block 206. In response to the monitored growth of the die stack, the one or more adjustable locking devices are adjusted to control the force exerted on the dies stack, as shown at block 208. As noted above, the various components of die locking device 100 can be formed of several different materials, and each of these materials may have different rates of thermal expansion. In general, as the die locking device is heated, it will expand and the pressure exerted on the locking arms and, ultimately, the detail dies, will increase. The expansion and pressure increase is not likely to be uniform around the device due to the differences in thermal expansion rates of the materials. The actuators in operable communication with the locking arms are configured to compensate for the increase in force exerted on the die stack. For example, in an embodiment employing hydraulic actuators, pressure can be bled out of the cylinders as the die stack grows due to the thermal expansion. As such, a constant desired force can be maintained on the die stack through the unique use of the electronically, pneumatically, or the like controlled actuators in communication with the locking arms.

The use of such an active-control system in the die locking device 100 eliminates the need for human interaction in manually adjusting lock bolts to compensate for differences in thermal expansion. This can lead to increased safety and reduced process time in an isothermal forging process. Moreover, the active-control system employing the actuators can more accurately control the pressure exerted on the die stack and adjust the pressure, when necessary, in near real-time.

In exemplary embodiments, the growth of the die stack may be monitored by various means including monitoring the force exerted on the adjustable locking devices by the die stack. In one embodiment, the adjustable locking device may include an actuator, such as a hydraulic actuator, configured to increase and decrease the force exerted on the die stack during heating. In exemplary embodiments, the adjustable locking devices can be configured to maintain at least a minimum force exerted by the one or more locking devices on the die stack to ensure that the detail dies do not move during the forging process. In exemplary embodiments, the adjustable locking devices can be configured to not exceed a maximum force exerted by the one or more locking devices on the die stack to ensure that the detail dies do not break during the forging process.

The terms "first," "second," and the like, herein do not denote any order, quantity, or importance, but rather are used to distinguish one element from another. The terms "a" and "an" herein do not denote a limitation of quantity, but rather denote the presence of at least one of the referenced item.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A die locking device, comprising:

a press comprising:
- a top end;
- a bottom end; and
- a plurality of channels disposed around a perimeter of the press;

a plurality of actuators, each of the plurality of actuators affixed to a first end of one of a plurality of locking arms that are each at least partially disposed in one of the plurality of channels;

a plurality of locking clips, each affixed to a second end of each of the plurality of locking arms and each affixed to one of a plurality of hinges;

wherein the plurality of hinges are configured to receive and secure a die stack to the top end of the press.

2. The die locking device of claim 1 further comprising a locking ring disposed between the plurality of hinges and the die stack.

3. The die locking device of claim 1, wherein the plurality of actuators are hydraulic.

4. The die locking device of claim 1, wherein the plurality of hinges are pivotally affixed to the top end of the press.

5. The die locking device of claim 1, wherein the each of the plurality of locking arms is slideably disposed in one of the plurality of channels such that the range of motion of the locking arm is limited to a direction to and from the top and bottom end of the press.

6. A method for die locking, comprising:

placing a die stack in a die locking device, comprising:

a press comprising:
- a top end;
- a bottom end; and
- a plurality of channels disposed around a perimeter of the press;

a plurality of actuators, each of the plurality of actuators affixed to a first end of one of a plurality of locking arms that are each at least partially disposed in one of the plurality of channels;

a plurality of locking clips, each affixed to a second end of each of the plurality of locking arms and each affixed to one of a plurality of hinges; and wherein the plurality of hinges are configured to receive and secure the die stack to the top end of the press;

monitoring a force exerted by the hinges on the die stack; and responsively adjusting the position of the plurality of actuators to maintain the force in a desired range.

7. The method of claim 6, wherein the locking device further comprises a locking ring disposed between the plurality of hinges and the die stack.

8. The method of claim 6, wherein the plurality of actuators are hydraulic.

9. The method of claim 6, wherein the plurality of hinges are affixed to the top end of the press.

10. The method of claim 6, wherein the each of the plurality of locking arms is slideably disposed in one of the plurality of channels such that the range of motion of the locking arm is limited to a direction to and from the top and bottom end of the press.

* * * * *